US008100698B2

(12) United States Patent
Zhu

(10) Patent No.: US 8,100,698 B2
(45) Date of Patent: Jan. 24, 2012

(54) ELECTRICAL CONNECTOR WITH REMOVABLE HOUSING

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/861,136

(22) Filed: Aug. 23, 2010

(65) Prior Publication Data

US 2011/0177702 A1 Jul. 21, 2011

(30) Foreign Application Priority Data

Jan. 19, 2010 (CN) ..... 201020301028

(51) Int. Cl.
*H01R 13/60* (2006.01)

(52) U.S. Cl. ..... 439/41; 439/135

(58) Field of Classification Search ..... 439/41, 439/42, 135, 940

See application file for complete search history.

(56) References Cited

U.S. PATENT DOCUMENTS 6,019,617 A * 2/2000 Liu et al. ..... 439/135
6,830,457 B1 * 12/2004 Korsunsky et al. ..... 439/41
7,442,043 B2 * 10/2008 Yuan et al. ..... 439/56
7,628,615 B2 * 12/2009 Lin et al. ..... 439/41

* cited by examiner

*Primary Examiner* — Khiem Nguyen

(74) *Attorney, Agent, or Firm* — Wei Te Chung; Andrew C. Cheng; Ming Chieh Chang

(57) ABSTRACT

An electrical connector includes an insulative housing and a plurality of contacts received in the housing. Each contact includes a body portion, a spring portion and a soldering tail. The insulative housing includes a smooth top face, a plurality of generally parallel ridges extending from an opposite face to the top face to provide with interposed grooves between every adjacent ridges. The body portions of the contacts are individually engaged in the corresponding grooves and the spring portions extend forwards beyond a front face of the housing. The insulating housing includes a mounting face opposite to the smooth top face for confronting with a printed circuit board and the soldering tails extend downwards beyond the mounting face.

8 Claims, 5 Drawing Sheets

ELECTRICAL CONNECTOR WITH REMOVABLE HOUSING

BACKGROUND OF THE INVENTION

1. Field of the Invention

The present invention relates to an electrical connector, and more particularly to an electrical connector with removable housing.

2. Description of Related Art

Currently, Miniaturization has become a trend in the consumer electronics industry. Such as Apple's fashionable Mac Air, iPhone, Amazon's Kindle E-book and so on. Therefore, it's easy to realize that connectors used in these shrinking devices are also facing a need for small size.

Hence, an electrical connector with low profile is desired continually.

BRIEF SUMMARY OF THE INVENTION

The present invention provides an electrical connector including an insulative housing and a plurality of contacts received in the housing. Each contact includes a body portion, a spring portion and a soldering tail. The insulative housing includes a smooth top face, a plurality of generally parallel ridges extending from an opposite face to the top face to provide with interposed grooves between every adjacent ridges. The body portions of the contacts are individually engaged in the corresponding grooves and the spring portions extend forwards beyond a front face of the housing. The insulating housing includes a mounting face opposite to the smooth top face for confronting with a printed circuit board and the soldering tails extend downwards beyond the mounting face.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
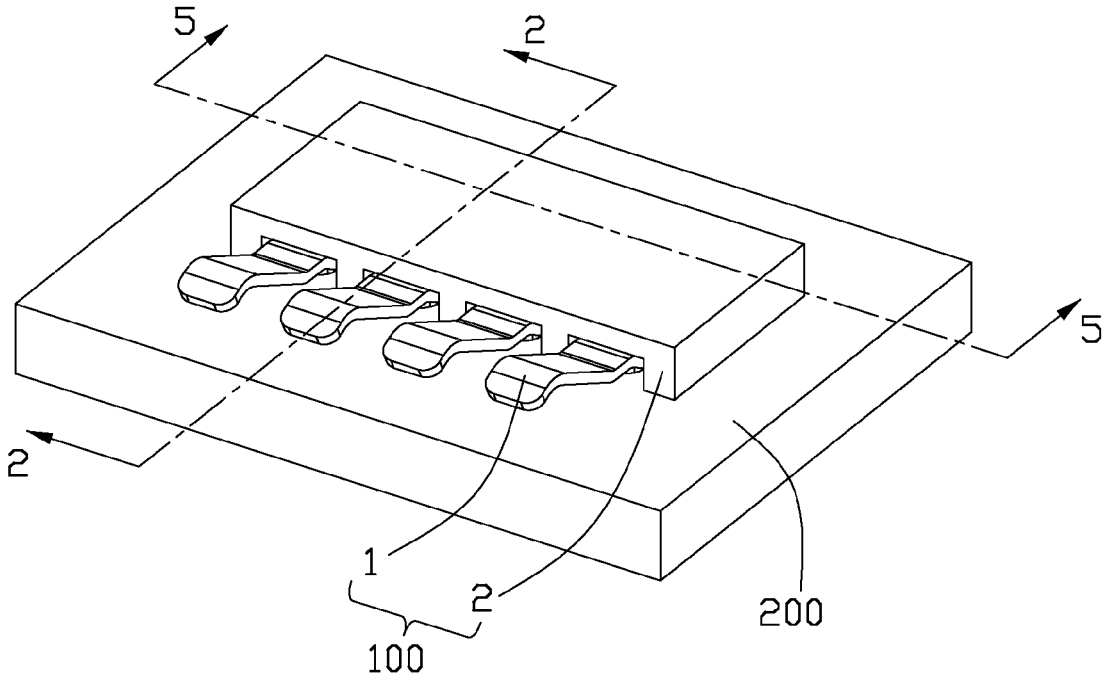
FIG. 1 is a perspective view of the electrical connector assembly.

Reference will now be made to the drawing figures to describe the preferred embodiment of the present invention in detail.

Figure 2:
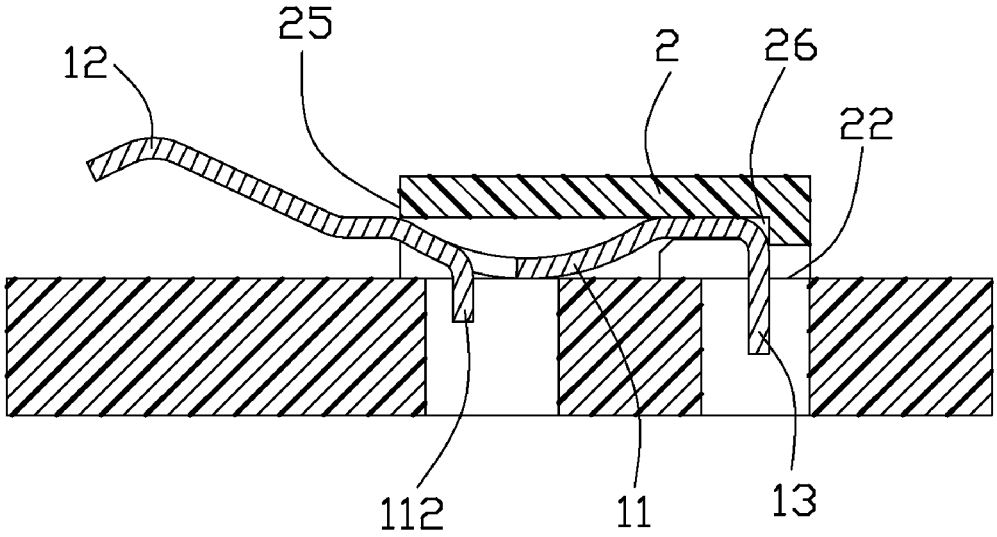
FIG. 2 is a cross section view of the electrical connector assembly taken from 2-2 line of FIG. 1.

FIGS. 1 and 2 illustrate an electrical connector 100 according to an embodiment of the present invention, which includes four plate contacts 1 and an insulative housing 2 which is used to shift the contacts to a printed circuit board 200 where the contacts are soldered. The housing is functioned as a pick up device. Contacts 1 are clipped and moved to the circuit board by the housing and soldered to the circuit board 200 through tails.

Figure 3:
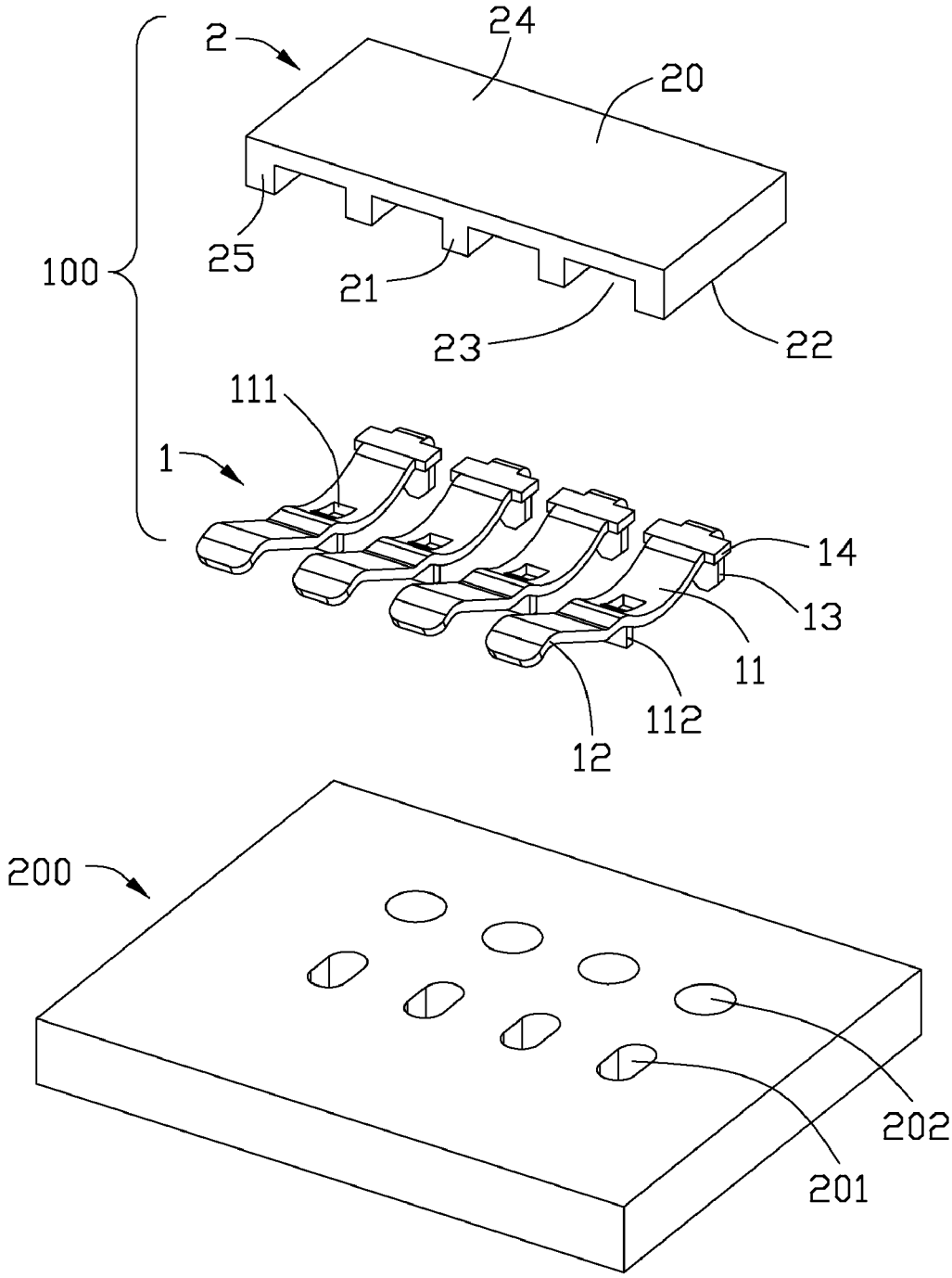
FIG. 3 is an exploded view of the electrical connector assembly as shown in FIG. 1.
Figure 4:
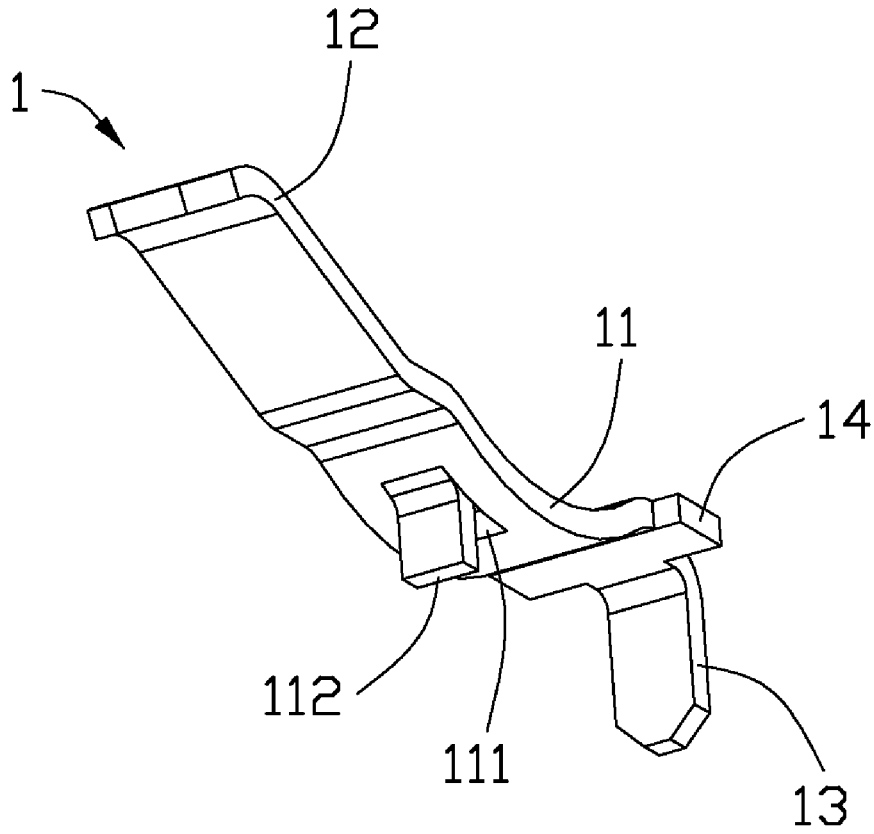
FIG. 4 is a perspective view of the contact according to the present invention.

Referring to FIGS. 3 and 4, the insulative housing 2 has an upper section 20, five generally parallel ridges 21 extending downwardly from a bottom of the upper section 20 and four grooves 23 interposed between adjacent ridges 21 for partitioning and holding the contacts 1. The upper section 20 defines a smooth top surface 24 for use in transporting the insulative housing 2 with the contacts 1 to the circuit board 200 by vacuum suction, served as an absorbing face. The bottom face 22 of the housing opposite to the top face confronts with the circuit board, served as a mounting face.

The circuit board 200 is provided with a row of oval holes 201 and a row of round holes 202 arranged parallel to the row of the oval holes for the contacts.

Referring to FIGS. 3 and 4, each contact 1 made from metal sheet includes a body portion 11, a spring portion 12 bending upwardly from the front end of the body portion 11 and the soldering tail 13 perpendicularly bending downwardly from the rear end of the body portion 11 with respect to the a spring portion 12. The additional tail 112 is made by tearing off from a portion of the body portion 11 adjacent to the spring portion and formed with a punched hole 111. The additional tail 112 is parallel to the soldering tail 13 to guide and position the contact on the circuit board when shifting, which can be inserted in the hole without soldering or soldering. The body portion 11 defines a pair of retaining ribs 14 at lateral sides thereof adjacent to the soldering tail 13.

Figure 5:
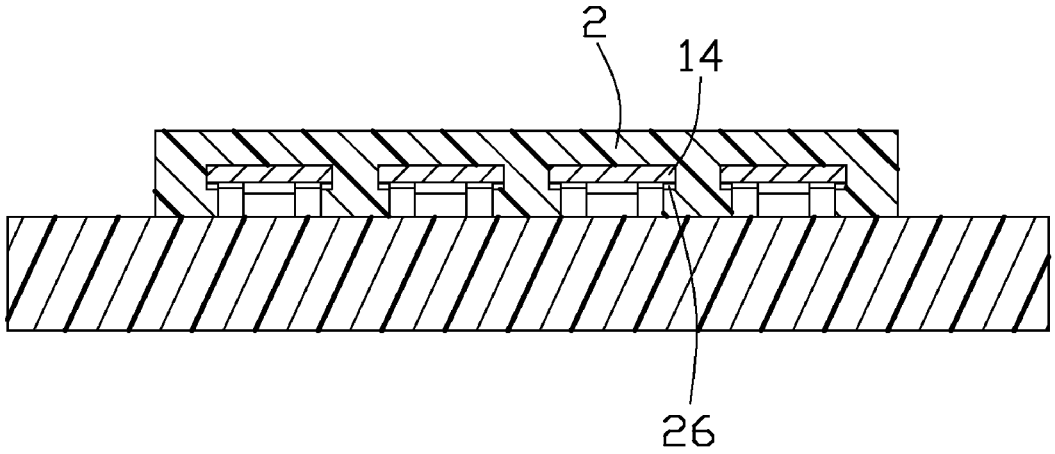
FIG. 5 is a cross section view of the electrical connector assembly taken from 5-5 line of FIG. 1.

Referring to FIGS. 3 to 5, The contacts 1 are received in the grooves 23 of the insulative housing 2 and frictionally engaged by adjacent ridges 21 when the contacts are inserted from a front face 25 of the housing. The retaining ribs 14 are inserted into slots 26 defined in a rear end of the grooves 23 to limit movement of the contacts 1 along a direction the contacts are arranged. Thus the contacts 1 are retained in the housing and then shift to the circuit board 200 by vacuum suction in a condition that the tails 112, 13 are inserted in the holes 201,202 respectively. Alternatively, the housing is removed firstly and then the tails are soldered to the circuit board.

Best shown in FIG. 2, The spring portion 12 slant forward beyond the front face 25 and over the top surface 24 of the insulative housing 2 so that the spring portion can provided an enough force to contact with other device (not shown). The tails 112, 13 protrude downward beyond the mounting face 22. The body portion is configured with a downward arc shape with a lower point beyond the mounting face 22 so that the body portion 11 can abut against the circuit board 200 to avoid deformation of the contacts 1.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising: a plurality of contacts, each contact comprising a body portion, a spring portion and a soldering tail; an insulative housing comprising a smooth top face, a plurality of generally parallel ridges extending from an opposite face to the top face to provide with interposed grooves between every adjacent ridges, the insulating housing defining a mounting face opposite to the smooth top face for confronting with a printed circuit board; the contacts being individually engaged in corresponding grooves; wherein the body portions are received in the grooves and the spring portions extend forwards beyond a front face of the housing, the soldering tails extend downwards beyond the mounting face, wherein the body portion defines an addition tail near to the spring portion, the additional tail is parallel to the soldering tail, wherein the body portions are in a shape of an downward arc with a lower point lower the mounting face, wherein the body portion defines a pair of retaining ribs at lateral sides thereof near to the soldering tail to be inserted slots defined in the groove, wherein the insulating housing is detachedly engaged with the contacts in a condition that the insulating housing is removed after the contacts are disposed on the printed circuit board, the top surface is used in transporting the contacts by vacuum suction.

2. The electrical connector as claimed in claim 1, wherein the spring portions extend upwards beyond the top face of the insulating housing.

3. An electrical connector assembly comprising: a printed circuit board defining a mounting surface; a row of contacts disposed upon the mounting surface of the printed circuit board, each of said contacts defining a solder tail fastened to the printed circuit board; and an insulative housing defining a plurality of grooves to receive the corresponding contacts therein, respectively, wherein said grooves are essentially fully downwardly exposed to the printed circuit board so as to allow said contacts not only to be upwardly assembled to the housing but also to be essentially fully exposed to the mounting surface of the printed circuit board under condition that each of said contacts defined one section abutting against the mounting surface of the printed circuit board in addition to said solder tail, wherein each of said contacts includes resilient arm exposed outside of the housing for mating, wherein a front region of the resilient arm extends upwardly above the housing away from the printed circuit board, wherein said resilient arm touches the mounting surface of the printed circuit board at least when said resilient arm is downwardly pressed by a complementary electronic component, wherein said resilient arm constantly touches the mounting surface of the printed circuit board, wherein each of said contacts defines a retention section which is located between the solder tail and an area where the resilient arm touches the printed circuit board.

4. The electrical connector assembly as claimed in claim 3, wherein the housing downwardly encloses a rear half of each of the contacts including the solder tail.

5. The electrical connector assembly as claimed in claim 3, wherein each of said contacts further includes another tail cooperating with the solder tail to commonly precisely mount said contact upon the printed circuit board.

6. The electrical connector assembly as claimed in claim 5, wherein said another tail extends downwardly into a corresponding through hole in the printed circuit board.

7. The electrical connector as claimed in claim 3, wherein the solder tail extends into a corresponding through hole in the printed circuit board.

8. The electrical connector as claimed in claim 7, wherein each of said contacts further includes another tail cooperating with the solder tail to commonly precisely mount said contact upon the printed circuit board, and said another tail extends downwardly into a corresponding through hole in the printed circuit board.

* * * * *